United States Patent [19]

Takano et al.

[11] Patent Number: 4,796,561

[45] Date of Patent: Jan. 10, 1989

[54] ELECTROPHOTOGRAPHIC DEVELOPING DEVICE HAVING A SHAPED DOCTOR BOARD

[75] Inventors: Yasuo Takano; Hiroyoshi Tokoro; Junji Kobayashi; Masato Yamada; Toshimitsu Harada; Kensei Hosoya, all of Ibaraki, Japan

[73] Assignee: Hitachi Koki Company, Limited, Tokyo, Japan

[21] Appl. No.: 95,716

[22] Filed: Sep. 14, 1987

[30] Foreign Application Priority Data

Sep. 12, 1986 [JP] Japan ..... 61-141109[U]

[51] Int. Cl.[4] ..... G03G 15/09

[52] U.S. Cl. ..... 118/657; 118/261; 355/3 DD

[58] Field of Search ..... 118/657, 658, 652, 661, 118/261; 355/3 DD

[56] References Cited

U.S. PATENT DOCUMENTS

| | | | |
|---|---|---|---|
| 4,275,683 | 6/1981 | Kutz et al. | 118/261 X |
| 4,575,220 | 3/1986 | Sakamoto et al. | 355/3 DD |

FOREIGN PATENT DOCUMENTS

| | | | |
|---|---|---|---|
| 0078574 | 5/1982 | Japan | 355/3 DD |
| 0229067 | 11/1985 | Japan | 355/3 DD |
| 0080182 | 4/1986 | Japan | 355/3 DD |
| 0090174 | 5/1986 | Japan | 355/3 DD |

OTHER PUBLICATIONS

PTO 88-1159, English translation of Japanese Kokai Patent 61-80182, May, 1988.

PTO 88-1160, English translation of Japanese Kokai Patent 61-90174, May, 1988.

*Primary Examiner*—Shrive Beck

*Assistant Examiner*—Alain Bashore

*Attorney, Agent, or Firm*—Sughrue, Mion, Zinn, Macpeak & Seas

[57] ABSTRACT

In an electrophotographic developing device, its doctor blade disposed adjacent to a magnetic roll so as to control the thickness of a layer of magnetic developing agent conveyed by the magnetic roll has an edge which is curved in such a manner that the gap between the edge and the magnetic roll is a minimum in the vicinity of the middle of the magnetic roll, whereby the layer of magnetic developing agent is made uniform in thickness and the printing density is made uniform despite gravitational sagging of the roll.

3 Claims, 2 Drawing Sheets

ELECTROPHOTOGRAPHIC DEVELOPING DEVICE HAVING A SHAPED DOCTOR BOARD

BACKGROUND OF THE INVENTION

1. Field of the Invention

This invention relates to an electrophotographic developing device.

2. Background of the Invention

The developing operation of a conventional electrophotographic developing device will be described with reference to FIGS. 1, 2 and 3.

As shown in FIG. 1, a photosensitive drum 1 is rotated in the direction of the arrow (a) and is charged by a charging device (not shown). Under this condition, a latent image is formed on the surface of the photosensitive drum 1 by an optical device (not shown). Magnetic developing agent 3 is caused to adhere to the latent image by a developing device 2. That is, the latent image is developed into a visible image. The magnetic developing agent 3 is stocked in the developing device 2. A developing roll 4 is disposed beside the photosensitive roll 1 with a small gap therebetween. The developing roll 4 has been magnetized. Therefore, as the developing roll 4 turns in the direction of the arrow (b), the magnetic developing agent is transported in the direction of the arrow (c) so that it sticks on the photosensitive drum 1. In this connection, printing density depends on the quantity of magnetic developing agent 3 adhered to the photosensitive drum 1. One factor controlling the quantity of magnetic developing agent 3 stuck on the photosensitive drum 1 is the thickness of the layer of magnetic developing agent 3 conveyed by the developing roll 4. Therefore, in order to make the printing density uniform in the longitudinal direction of the photosensitive drum 1, a doctor board 5 is arranged along the photosensitive drum with a small gap therebetween. Since the gap between the doctor board 5 and the photosensitive drum is uniform, the layer of magnetic developing agent 3 conveyed by the developing roll 4 is made uniform in thickness, as a result of which the printing density is uniform.

As is apparent from the above description, in the conventional developing device, the edge of the doctor board 5 must be straight. That is, in FIG. 2, a front view of the developing device, the gap between the doctor board 5 and the developing roll 4 is uniform at any point; $g_1=g_2=g_3$. However, as the developing roll 4 is rotated in the direction of the arrow (b), a load is formed in the gap between the doctor board 5 and the developing roll 4, so that the developing roll 4 is bent. That is, the gap between the doctor board 5 and the developing roll 4 is changed, with the result that the printing density is not uniform. If the layer of magnetic developing agent 3 on the developing roll 4 is excessively large in thickness, then the image developed on the photosensitive drum 1 is spoiled by the a magnetic stripe of magnetic developing agent 3, so that the printing quality is lowered.

The bend of the developing roll 4 will be described with reference to FIG. 3 in more detail. When a uniformly distributed load w is applied to the developing roll 4, then the developing roll 4, with bearings 6 at both ends acting as fulcrums, is bent as indicated by the broken line. The amount of deflection y of the developing roll 4 can be approximated according to the following quartic equation (1):

$$y=w(l^3x-2lx^3+x^4)/24EI \quad (1)$$

where x is the distance between either bearing 6 and a given point, E is the modulus of longitudinal elasticity, and I is the geometrical moment of inertia of the developing roll 4.

As is apparent from the equation, the amount of deflection is larger towards the middle of the roll 4 where $g_1 \simeq g_3 < g_2$.

SUMMARY OF THE INVENTION

Accordingly, an object of this invention is to eliminate the above-described difficulties accompanying a conventional electrophotographic developing device.

More specifically, an object of the invention is to provide an electrophotographic developing device in which the layer of magnetic developing agent is made uniform in thickness whereby the printing density is maintained uniform and the printing quality is improved.

The foregoing object and other objects of the invention have been achieved by the provision of an electrophotographic developing device comprising a magnetic roll rotatably supported therein and a doctor board disposed adjacent to the magnetic roll. The doctor board controls the thickness of a layer of magnetic developing agent forwarded by the magnetic roll. According to the invention, the doctor board has an edge confronting the magnetic roll and shaped in such a manner that the gap between the edge and the magnetic roll is at a minimum in the vicinity of the middle of the doctor board when the roll is stationary, and is substantially uniform along the entire length of the edge when the roll is rotating, thereby assuring a uniform thickness of the layer of developing agent applied to a photosensitive drum rotating adjacent the magnetic roll.

The nature, principle and utility of the invention will become more apparent from the following detailed description when read in conjunction with the accompanying drawings, in which like parts are designated by like reference numerals.

DETAILED DESCRIPTION OF THE INVENTION

Figure 4:
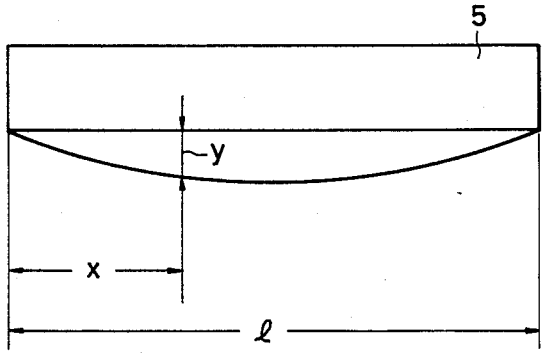
FIG. 4 is a front view showing a first example of a doctor board in an electrophotographic developing device according to this invention.

An electrophotographic developing device according to this invention in one embodiment thereof comprises a doctor board 5 as shown in FIG. 4.

Figure 1:
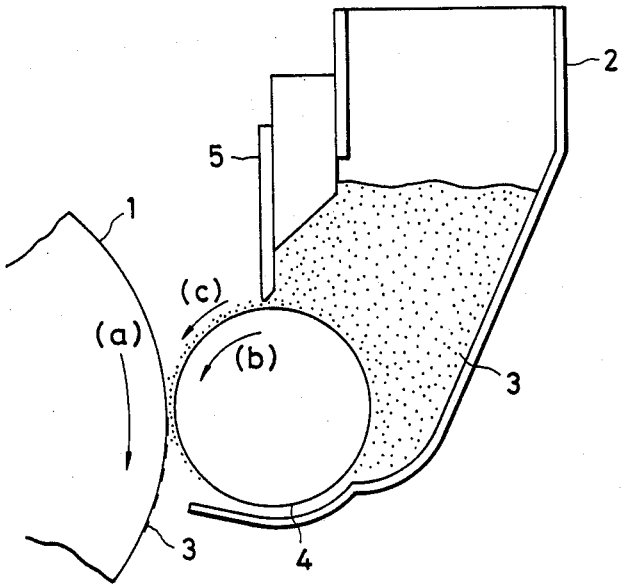
FIG. 1 (PRIOR ART)
FIG. 1 is a sectional view taken along line A—A in FIG. 2.
Figure 2:
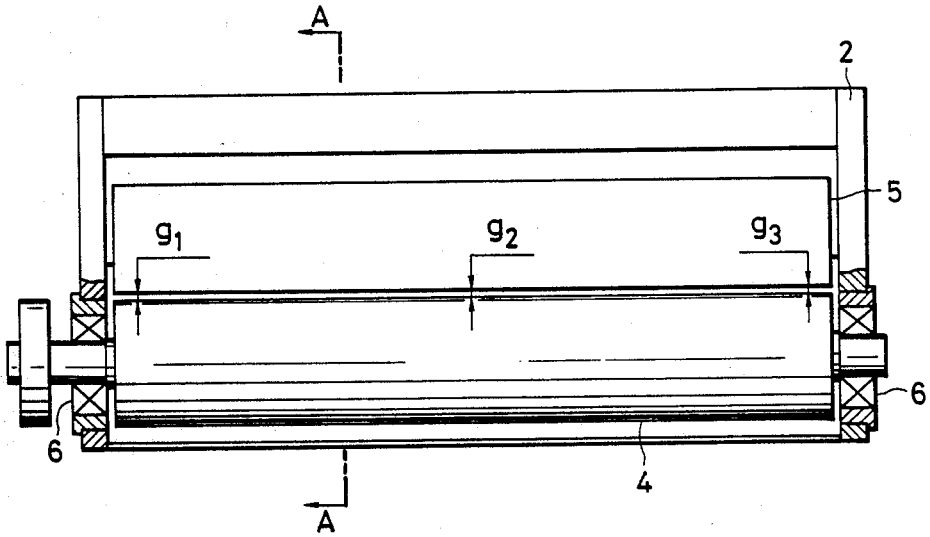
FIG. 2 (PRIOR ART)
FIG. 2 is a front view of a conventional electrophotographic developing device.
Figure 3:
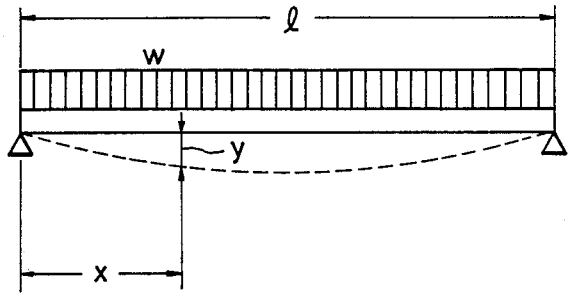
FIG. 3 (PRIOR ART)
FIG. 3 is an explanatory diagram for a description of the deflection of a developing roll in the device.

The edge of the doctor board 5 is fabricated so as to be curved substantially according to the above-described equation (1) representing the amount of deflection of the developing roll 4. That is, in FIG. 1, the amount of deflection y is determined according to the quartic equation (1).

In the electrophotographic developing device with the doctor board 5 as shown in FIG. 4, when the developing roll 4 is not in rotation, the gap between the doctor board 5 and the developing roll 4 is not uniform i.e. $g_1 = g_3 > g_2$. However, when the developing roll 4 is rotated, the gap becomes substantially uniform because the developing roll 4 is bent by the rotation.

Figure 5:
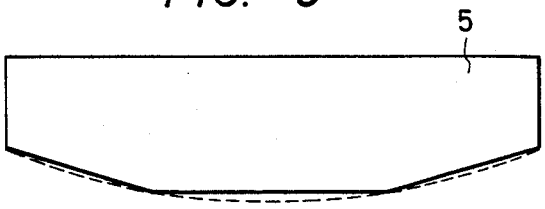
FIG. 5 is a front view showing a second example of the doctor board shown in FIG. 4.

FIG. 5 is a modification of the doctor board 5 according to the invention. That is, the doctor board 5 is so shaped that the edge, as indicated by the solid line, approximates its curved line (indicated by the broken line) of the doctor board 5 of FIG. 4. More specifically, the edge consists of a line parallel with the longitudinal axis of the doctor board 5 and two sloped lines. With the modification, substantially the same effect can be obtained.

As was described above, in the electrophotographic developing device of the invention, the edge of the doctor board is so shaped as to eliminate the difficulty of the conventional developing device in which the gap between the doctor board and the developing roll becomes non-uniform because the developing roll is bent by the load formed in the gap. Therefore, in the electrophotographic developing device of the invention, when the developing roll is rotated, the gap between the developing roll and the doctor board is maintained uniform, as a result of which the printing density is also uniform. Furthermore, the electrophotographic developing device of the invention is free from the difficulty that the printing quality is lowered by the magnetic brush when the gap between the doctor board and the developing roll is excessively increased.

We claim:

1. An electrophotographic developing device comprising:

a magnetic roll rotatably suported at bearing points in an electrographic developing device; and a fixed doctor board disposed adjacent to, and spaced from, said magnetic roll for controlling the thickness of a layer of magnetic developing agent forwarded by said magnetic roll, wherein said doctor board has a longitudinal edge which confronts said magnetic roll and which is shaped in such a manner that a gap between said edge and said magnetic roll varies and has a minimum in the vicinity of the middle of said magnetic roll when said magnetic roll is stationary, and is substantially uniform along the entire length of the magnetic roll when said magnetic roll is rotating, thereby assuring a uniform thickness of said layer of said magnetic developing agent applied to a photosensitive drum rotating adjacent said rotating magnetic roll.

2. An electrographic developing device as recited in claim 1, wherein said gap varies substantially as a quartic function of the longitudinal distance from either bearing point when said magnetic roll is rotating, and wherein said edge is curved substantially according to said quartic function.

3. An electrographic developing device as recited in claim 1, wherein said gap varies substantially as a quartic function of the longitudinal distance from either bearing point when said magnetic roll is rotating; and wherein said edge comprises a central straight portion parallel to a straight line between said bearing points, and two side straight portions on either side of said central portion and inclined to said straight line, said central and said two side straight portions forming a longitudinal edge approximating a curve defined by said quartic function.

* * * * *